US009799983B2

(12) United States Patent
Lane et al.

(10) Patent No.: US 9,799,983 B2
(45) Date of Patent: Oct. 24, 2017

(54) CONNECTOR ASSEMBLY

(71) Applicant: TYCO ELECTRONICS CORPORATION, Berwyn, PA (US)

(72) Inventors: David James Lane, Hummelstown, PA (US); Galen M. Martin, Camp Hill, PA (US); Douglas John Hardy, Middletown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/001,819

(22) Filed: Jan. 20, 2016

(65) Prior Publication Data

US 2017/0207568 A1 Jul. 20, 2017

(51) Int. Cl.

| | |
|---|---|
| ***H01R 13/52*** | (2006.01) |
| ***H01R 24/40*** | (2011.01) |
| ***H01R 4/20*** | (2006.01) |
| *H01R 107/00* | (2006.01) |

(52) U.S. Cl.

CPC ..... *H01R 13/5205* (2013.01); *H01R 4/20* (2013.01); *H01R 24/40* (2013.01); *H01R 2107/00* (2013.01)

(58) Field of Classification Search

CPC ..... H01R 13/5202; H01R 13/5205; H01R 13/5219; H01R 13/5221; H01R 33/965

USPC ..... 439/274, 275, 587, 271, 224, 289

See application file for complete search history.

(56) References Cited

U.S. PATENT DOCUMENTS

| | | | | |
|---|---|---|---|---|
| 7,568,933 | B2 * | 8/2009 | Shirai | H01R 13/641 439/271 |
| 8,366,483 | B2 * | 2/2013 | Hardy | H01R 9/0518 439/578 |
| 2007/0293075 | A1 * | 12/2007 | Sakamoto | H01R 13/5208 439/274 |

* cited by examiner

*Primary Examiner* — Phuong Dinh

(57) ABSTRACT

A connector assembly includes an electrical contact subassembly and an outer housing. The contact subassembly is terminated to an electrical cable. The outer housing defines a cavity and holds the contact subassembly in the cavity. A mating segment of the outer housing defines a socket of the cavity that is configured to receive a plug end of a mating connector assembly. The outer housing further includes an interface seal within the cavity. The interface seal is configured to engage the plug end of the mating connector assembly during a mating operation to seal an interface between the connector assembly and the mating connector assembly. The seal may be formed by in-situ molding in the outer housing.

20 Claims, 7 Drawing Sheets

CONNECTOR ASSEMBLY

BACKGROUND OF THE INVENTION

The subject matter herein relates generally to connector assemblies.

Radio frequency (RF) connector assemblies are used for numerous applications including military applications and automotive applications. For example, RF connector assemblies may be used with global positioning systems (GPS), antennas, radios, mobile phones, multimedia devices, and the like. The connector assemblies are typically coaxial cable connectors that are provided at the end of coaxial cables. In one or more of the identified applications, the connector assemblies may be exposed to debris, contaminants, and environmental elements, such as dirt, oil, water, freezing temperatures, and the like. The debris, contaminants, and elements may disrupt the electrical signal path through the connector assemblies and/or damage the electrical components of the connector assemblies if allowed access to the electrical components that provide the electrical signal path.

It may be difficult to adequately seal some connector assemblies due to the presence of multiple openings defined along a housing of a corresponding connector assembly, which each may serve as an ingress location for debris, contaminants, and elements into the internal cavity of the connector assembly. In addition, some connector assemblies may have a small size with limited space available for providing a seal or gasket at various openings and interfaces. For example, the space available for a seal may be so constrained that it is difficult to assemble or install a pre-molded seal into the connector assembly. In addition, the space may be so constrained that a pre-molded seal may have to be significantly small and/or thin to fit within the available space, and such seal may risk tearing or rolling out of position during assembly or during use, causing leak paths around the seal.

Although one solution to the issue of limited space availability could be to increase the size of the connector assemblies, many connector assemblies are standardized according to certain industry standards for specific types of connector assemblies. The industry standards may prevent such a size increase in the connector assemblies in order to better accommodate pre-molded seals to seal the connector assemblies from the external debris, contaminants, and elements.

A need remains for a connector assembly that provides adequate sealing from external debris, contaminants, and elements in a cost effective and reliable manner.

BRIEF DESCRIPTION OF THE INVENTION

In one embodiment, a connector assembly is provided that includes an electrical contact subassembly and an outer housing. The contact subassembly extends between a contact end and a terminating end. The terminating end is terminated to an electrical cable. The outer housing defines a cavity that extends between a mating end and a cable end of the outer housing. The outer housing holds the contact subassembly in the cavity. A mating segment of the outer housing extends to the mating end and defines a socket of the cavity that is configured to receive a plug end of a mating connector assembly. The outer housing further includes an interface seal within the cavity. The interface seal is configured to engage the plug end of the mating connector assembly during a mating operation to seal an interface between the connector assembly and the mating connector assembly.

In another embodiment, a connector assembly is provided that includes an electrical contact subassembly, an outer housing, and an interface seal. The contact subassembly extends between a contact end and a terminating end. The terminating end is terminated to an electrical cable. The outer housing defines a cavity that extends between a mating end and a cable end of the outer housing. The outer housing holds the contact subassembly in the cavity. A mating segment of the outer housing extends to the mating end and defines a socket of the cavity that is configured to receive a plug end of a mating connector assembly. The outer housing further includes a boss within the cavity and defines an annular gap radially between an outer surface of the boss and an inner surface of the mating segment. An interface seal is disposed within the annular gap. The interface seal has a molded body that follows contours of both the inner surface of the mating segment and the outer surface of the boss along the annular gap such that an interior side of the interface seal is defined by a profile of the outer surface of the boss and an exterior side of the interface seal is defined by a profile of the inner surface of the mating segment. The interface seal is configured to engage the plug end of the mating connector assembly during a mating operation to seal an interface between the connector assembly and the mating connector assembly.

In another embodiment, a connector assembly is provided that includes an electrical contact subassembly, an outer housing, an interface seal, and a wire seal. The contact subassembly extends between a contact end and a terminating end. The terminating end is terminated to an electrical cable. The outer housing defines a cavity that extends between a mating end and a cable end of the outer housing. The outer housing holds the contact subassembly in the cavity. The electrical cable extends from the cavity through the cable end. A mating segment of the outer housing extends to the mating end and defines a socket of the cavity that is configured to receive a plug end of a mating connector assembly. The outer housing further includes a boss within the cavity and defines an annular gap radially between an outer surface of the boss and an inner surface of the mating segment. The interface seal is disposed within the annular gap of the outer housing. The interface seal is configured to engage the plug end of the mating connector assembly during a mating operation to seal an interface between the connector assembly and the mating connector assembly. The wire seal is disposed within the cavity at the cable end and surrounds the electrical wire to seal a cable opening of the cavity at the cable end.

DETAILED DESCRIPTION OF THE INVENTION

Figure 1:
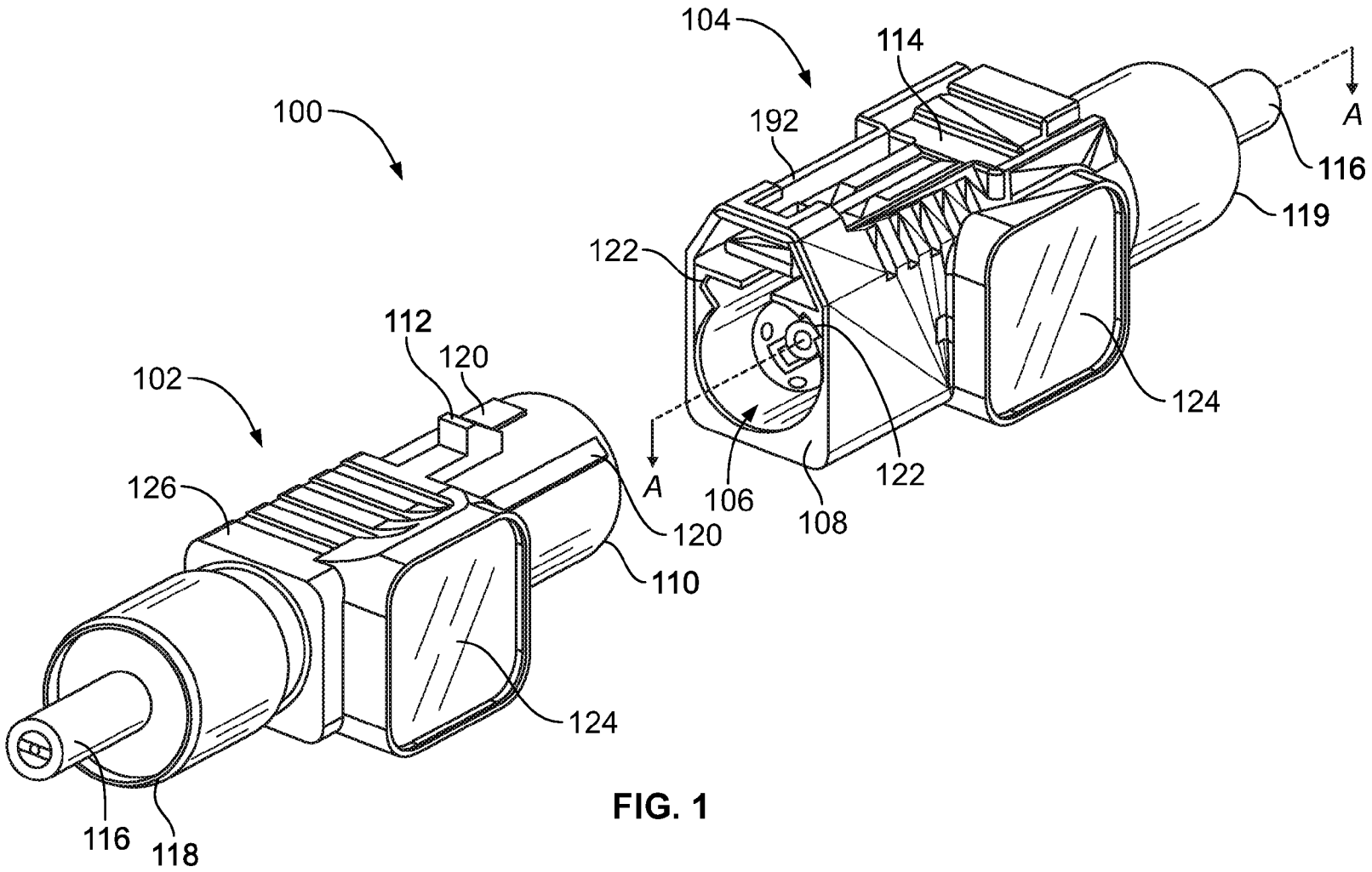
FIG. 1 illustrates a connector system formed in accordance with one embodiment including a first connector assembly and a second connector assembly.

FIG. 1 illustrates a connector system 100 formed in accordance with an exemplary embodiment. The connector system 100 includes a first connector assembly 102 and a second connector assembly 104. The first connector assembly 102 and the second connector assembly 104 are configured to be connected together to transmit electrical signals therebetween. For example, one or more electrical conductors of the first connector assembly 102 may engage respective electrical conductor(s) of the second connector assembly 104 when the connector assemblies 102, 104 are connected to provide a conductive signal path across the connector assemblies 102, 104.

In the illustrated embodiment, the first connector assembly 102 and the second connector assembly 104 are designed in accordance with certain industry standards. For example, the connector assemblies 102, 104 may constitute FAKRA connectors. FAKRA is an abbreviation for the German term Fachnormenausschuss Kraftfahrzeugindustrie, and is the Automotive Standards Committee in the German Institute for Standardization, representing international standardization interests in the automotive field. FAKRA connectors are RF connectors that have an interface that complies with the standard for a uniform connector system established by the FAKRA automobile expert group. The FAKRA connectors have a standardized keying system and locking system that fulfill the high functional and safety requirements of automotive applications. The FAKRA connectors are based on a subminiature version B connector (SMB connector) that feature snap-on coupling and are designed to operate at specific impedances, such as 50, 75, 93, and/or 125 Ohms. The connector system 100 may utilize other types of connectors other than the FAKRA connectors described herein.

The first and second connector assemblies 102, 104 are shown poised for mating in the illustrated embodiment. The second connector assembly 104 defines a socket 106 at a mating end 108 of an outer housing 192. The second connector assembly 104 is configured to receive a plug end 110 of an outer housing 126 of the first connector assembly 102 in the socket 106 during a mating operation. For this reason, the first connector assembly 102 is optionally referred to as a plug assembly, and the second connector assembly 104 is referred to as a receptacle assembly. The outer housing 126 of the first connector assembly 102 has a latching feature 112 that is configured to engage a corresponding latching feature 114 on the outer housing 192 of the second connector assembly 104 once the connector assemblies 102, 104 are mated to retain a mating connection between the connector assemblies 102, 104. In the illustrated embodiment, the latching feature 112 is a catch, and the latching feature 114 is a deflectable latch that engages the catch. The first and second connector assemblies 102, 104 are each terminated to respective cables 116. The cables 116 may be coaxial cables, such as types 1.5D, RTK-031, or the like. Signals transmitted along the cables 116 are transferred through the first and second connector assemblies 102, 104 when mated. The cables 116 extend from respective cable ends 118, 119 of the outer housings 126, 192 of the connector assemblies 102, 104.

The first connector assembly 102 has one or more keying features 120. The second connector assembly 104 has one or more keying features 122 that correspond with the keying features 120 of the first connector assembly 102. In the illustrated embodiment, the keying features 120 of the first connector assembly 102 are ribs, and the corresponding keying features 122 of the second connector assembly 104 are channels that receive the ribs. The keying features 120, 122 may have other shapes, sizes, and/or numbers in other embodiments. The keying features 120, 122 may be part of a standardized design of the FAKRA connector standard.

In one or more embodiments described herein, the connector assemblies 102, 104 include one or more seals to protect the electrical conductors and other components within the connector assemblies 102, 104 from external debris, contaminants, and/or elements (such as harsh temperatures, humidity, and the like). For example, the connector assemblies 102, 104 may be used in various industrial applications, such as automotive and military applications, that may expose the connector assemblies 102, 104 to debris, contaminants, and/or harsh elements. The one or more embodiments described herein provide sealing for the connector assemblies 102, 104 to prevent such debris, contaminants, and/or elements from interfering with and/or damaging the signal path across the connector assemblies 102, 104. For example, sealing may be provided at the cable ends 118, 119, at the interface between the connector assemblies 102, 104, and/or at any other openings, such as openings that receive add-on components. For example, in the illustrated embodiment, both connector assemblies 102, 104 include a respective retainer clip 124 that is sealingly coupled to the respective connector assembly 102, 104, as described in more detail herein. As a result, one or more embodiments provide a connector system 100 (including first and second connector assemblies 102, 104) that is configured to be fully sealed from the external environment, such as debris, contaminants, and elements, when the connector assemblies 102, 104 are mated to one another.

Figure 2:
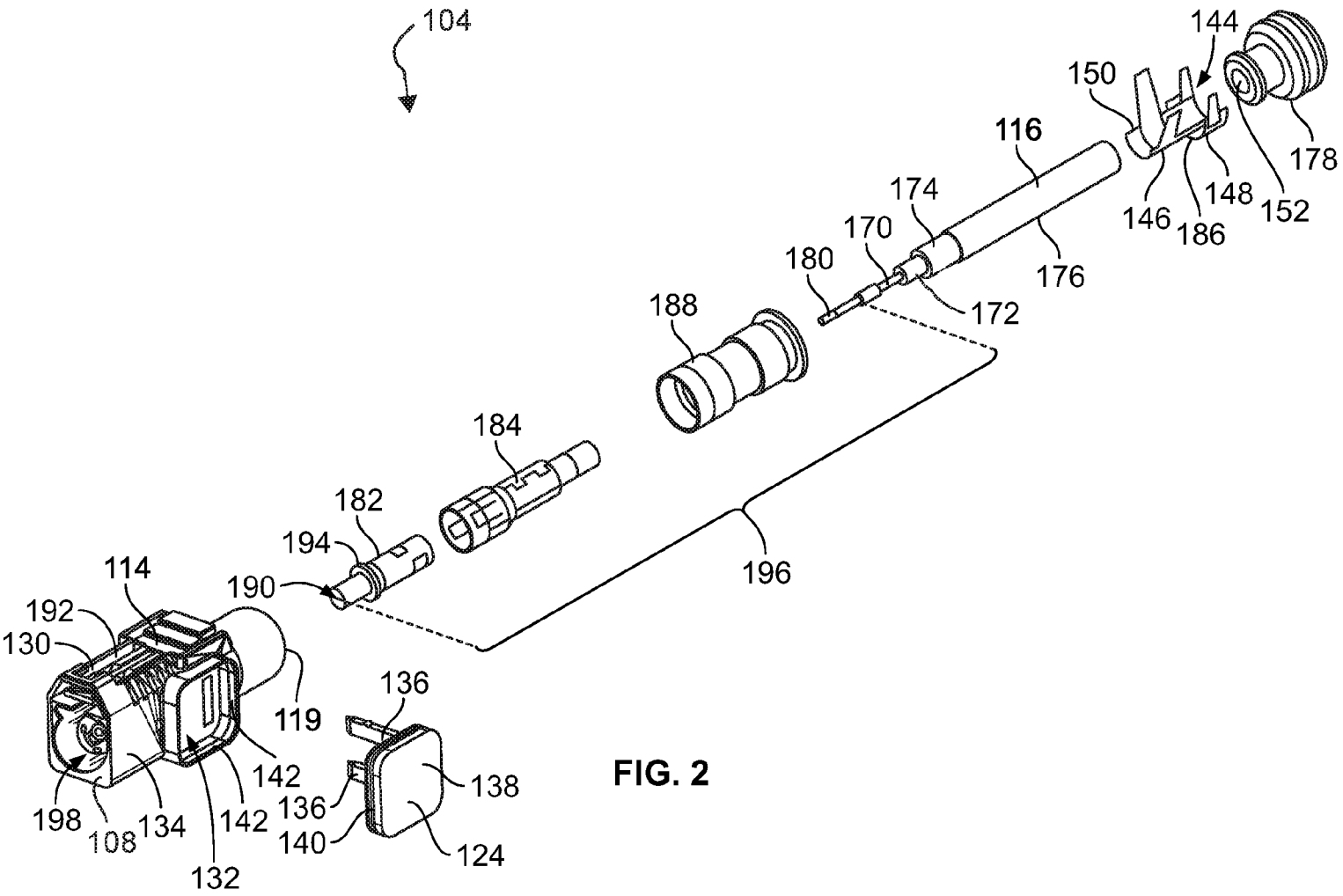
FIG. 2 is an exploded view of the second connector assembly shown in FIG. 1 according to an embodiment.

FIG. 2 is an exploded view of the second connector assembly 104 according to an embodiment. The second connector assembly 104 includes an electrical contact subassembly 196 and an outer housing 192. The electrical contact subassembly 196 includes a center contact 180, a dielectric body 182, an outer contact 184, and a cavity insert 188. The cable 116 that terminates to the second connector assembly 104 is also shown in FIG. 2. An outer ferrule 186 may be used to fasten the cable 116 to the second connector assembly 104. A wire seal 178 is configured to surround the cable 116 to seal the cable end 119 of the second connector assembly 104. The connector assembly 104 also includes the retainer clip 124. In other embodiments, the connector assembly 104 may include one or more additional components and/or may not include all of the components listed above. Although FIG. 2 is directed to the second connector assembly 104, the description may also apply to the first connector assembly 102 (shown in FIG. 1). For example, the first connector assembly 102 may also have a contact subassembly (not shown) within the outer housing 126 (FIG. 1) that includes a center contact, a dielectric body, an outer contact, and a cavity insert. The center contact and the outer contact may be configured to engage and electrically connect to the center contact 180 and the outer contact 184, respectfully, of the second connector assembly 104.

The cable 116 has a center conductor 170 that is surrounded by a dielectric layer 172. A cable braid 174 surrounds the dielectric layer 172. The cable braid 174 provides shielding for the center conductor 170 along the length of the cable 116. A cable jacket 176 surrounds the cable braid 174 and provides protection for the cable braid 174, the dielectric layer 172, and the center conductor 170 from external forces and contaminants.

The center contact 180 is formed of an electrically conductive material, such as one or more metals. In the illustrated embodiment, the center contact 180 of the second connector assembly 104 constitutes a socket-style contact that is configured to receive and electrically engage a pin contact of the first connector assembly 102 (shown in FIG. 1). However, the center contact 180 may be another type of contact in an alternative embodiment, such as a pin contact. The center contact 180 is terminated to the center conductor 170 of the cable 116. For example, the center contact 180 may be crimped to the center conductor 170.

The dielectric body 182 receives and holds the center contact 180 and may also hold a portion of the center conductor 170 of the cable 116. The dielectric body 182 is received within the outer contact 184 during assembly. The dielectric body 182 electrically insulates the center contact 180 from the outer contact 184. The dielectric body 182 has a cavity 190 that receives the center contact 180 therein. The dielectric body 182 may include a flange 194 that extends radially outward along a perimeter of the dielectric body 182. The flange 194 may be used to position and retain the dielectric body 182 within the outer contact 184.

The outer contact 184 surrounds the dielectric body 182 (and the center contact 180 therein). The outer contact 184 provides shielding for the center contact 180, such as from electromagnetic or radio frequency interference. The outer contact 184 is formed of an electrically conductive material, such as one or more metals. In an embodiment, the outer contact 184 is stamped and formed from a generally flat workpiece, such as a panel or sheet of metal. The outer contact 184 may be configured to be electrically connected to the cable braid 174 or another conductive component of the cable 116.

The cavity insert 188 surrounds a perimeter of the outer contact 184 along at least an axial segment of the outer contact 184. The cavity insert 188 is received within the outer housing 192. The cavity insert 188 is used to hold the outer contact 184 within the outer housing 192. For example, the cavity insert 188 may have a predetermined outer perimeter that corresponds with the outer housing 192 such that the cavity insert 188 engages the outer housing 192 and is secured within the outer housing 192. An inner perimeter of the cavity insert 188 engages the outer contact 184 and secures the outer contact 184 to the cavity insert 188. The cavity insert 188 thus is configured to retain the outer contact 184 in the outer housing 192. The cavity insert 188 may be an adapter member that allows multiple different outer contacts to be held within a single outer housing and/or allows for a single outer contact to be held within multiple different outer housings. The cavity insert 188 may be formed of a dielectric material, such as one or more thermoplastics or other polymers.

The contact subassembly 196, including the center contact 180, the dielectric body 182, the outer contact 184, and the cavity insert 188, is configured to be loaded into the outer housing 192. The contact subassembly 196 optionally may be assembled and then loaded into the outer housing 192 as a unit. The contact subassembly 196 may be assembled by loading the center contact 180 into the cavity 190 of the dielectric body 182, loading the dielectric body 182 into the outer contact 184, and also loading the outer contact 184 into the cavity insert 188, in that order or another order. The order of assembly is not limited to one specific order.

The outer housing 192 defines a cavity 198 that receives the contact subassembly 196 therein. The cavity 198 extends between the mating end 108 and the cable end 119 of the outer housing 192. The housing 192 may have a generally box-shaped outer profile that includes multiple sides. For example, the latching feature 114 may be provided along a first side 130 of the outer housing 192, and the retainer clip 124 may be received in a retainer opening 132 defined along a second side 134 of the outer housing 192. The first and second sides 130, 134 are adjacent to one another in the illustrated embodiment, although in other embodiments the first and second sides 130, 134 may be arranged in opposite relative positions or may not be adjacent to one another. The cavity 198 of the outer housing 192 is generally a cylindrical bore extending through the outer housing 192. The cavity 198 may have steps, shoulders and/or channels formed therein for engaging and holding the cavity insert 188 and/or other components of the contact subassembly 196.

The retainer clip 124 may be installed in the outer housing 192 to hold the contact subassembly 196 in the cavity 198 and provide position assurance. For example, the retainer clip 124 includes at least one arm 136 that extends from a base 138. The retainer clip 124 in FIG. 2 includes two arms 136 that extend in a common direction from the base 138. The arms 136 extend through the retainer opening 132 when the retainer clip 124 is coupled to the outer housing 192. The arms 136 engage the contact subassembly 196 to hold the contact subassembly 196 in position within the cavity 198. For example, the arms 136 may directly engage the cavity insert 188, the outer contact 184, and/or the outer ferrule 186 within the cavity 198. The retainer clip 124 in an embodiment includes a retainer seal 140 that surrounds at least a portion of the base 138. The retainer seal 140 is configured to engage port walls 142 of the outer housing 192 that surround the retainer opening 132 to seal the retainer opening 132 from external debris, contaminants, and elements.

The outer ferrule 186 is configured to be crimped to the cable 116 and the outer contact 184. The outer ferrule 186 provides an electrical connection between the cable braid 174 and the outer contact 184. The outer ferrule 186 also provides a mechanical connection between the cable 116 and the outer contact 184 to provide strain relief at the interface. The outer ferrule 186 may be configured to be crimped to both the cable braid 174 and the cable jacket 176 of the cable 116. Optionally, the outer ferrule 186 may be stamped and formed from a flat workpiece. The outer ferrule 186 may be formed into an open barrel shape, or alternatively into a closed barrel shape. The outer ferrule 186 defines a channel 144 that receives the cable 116 and the outer contact 184 therein. The outer ferrule 186 includes a braid segment 146 that is configured to crimp the cable braid 174 to the outer contact 184, and a jacket segment 148 that is configured to engage the cable jacket 176 to provide stress and strain relief. The outer ferrule 186 may define grooves or serrations 150 to enhance the grip of the outer ferrule 186 on the cable 116 and outer contact 184.

The wire seal 178 is configured to provide sealing at the cable end 119 of the outer housing 192. The wire seal 178 defines an opening 152 therethrough that receives the cable 116, such that the wire seal 178 surrounds the cable 116. The wire seal 178 is at least partially received in the cavity 198 of the outer housing 192 at the cable end 119. An outer perimeter of the wire seal 178 engages the walls of the outer housing 192 surrounding the cavity 198 in order to fill the annular void between the cable 116 and the outer housing 192 at the cable end 119, plugging the cavity 198 at the cable end 119. The wire seal 178 may be composed of a compressible material, such as a rubberized polymer compound. In an embodiment, at least a portion of the wire seal 178 surrounds the cable jacket 176 and is engaged by the jacket segment 148 of the outer ferrule 186 to hold the wire seal 178 in position on the cable jacket 176.

As described above, the wire seal 178 and the retainer seal 140 provide sealing for the outer housing 192 against external debris, contaminants, and/or elements. The debris may include, for example, sand, dirt, mud, salt, and the like. The contaminants may include oil, various chemicals, exhaust gases, water, and the like. The elements may include harsh temperatures, various precipitation (such as ice, sleet, snow, rain, etc.), humidity, sunlight, wind, and the like. The lists above are intended to provide merely some examples of possible debris, contaminants, and elements that may detrimentally affect the functioning of the connector system 100 (shown in FIG. 1) if allowed access into the outer housing 126 (FIG. 1) and/or the outer housing 192.

Figure 3:
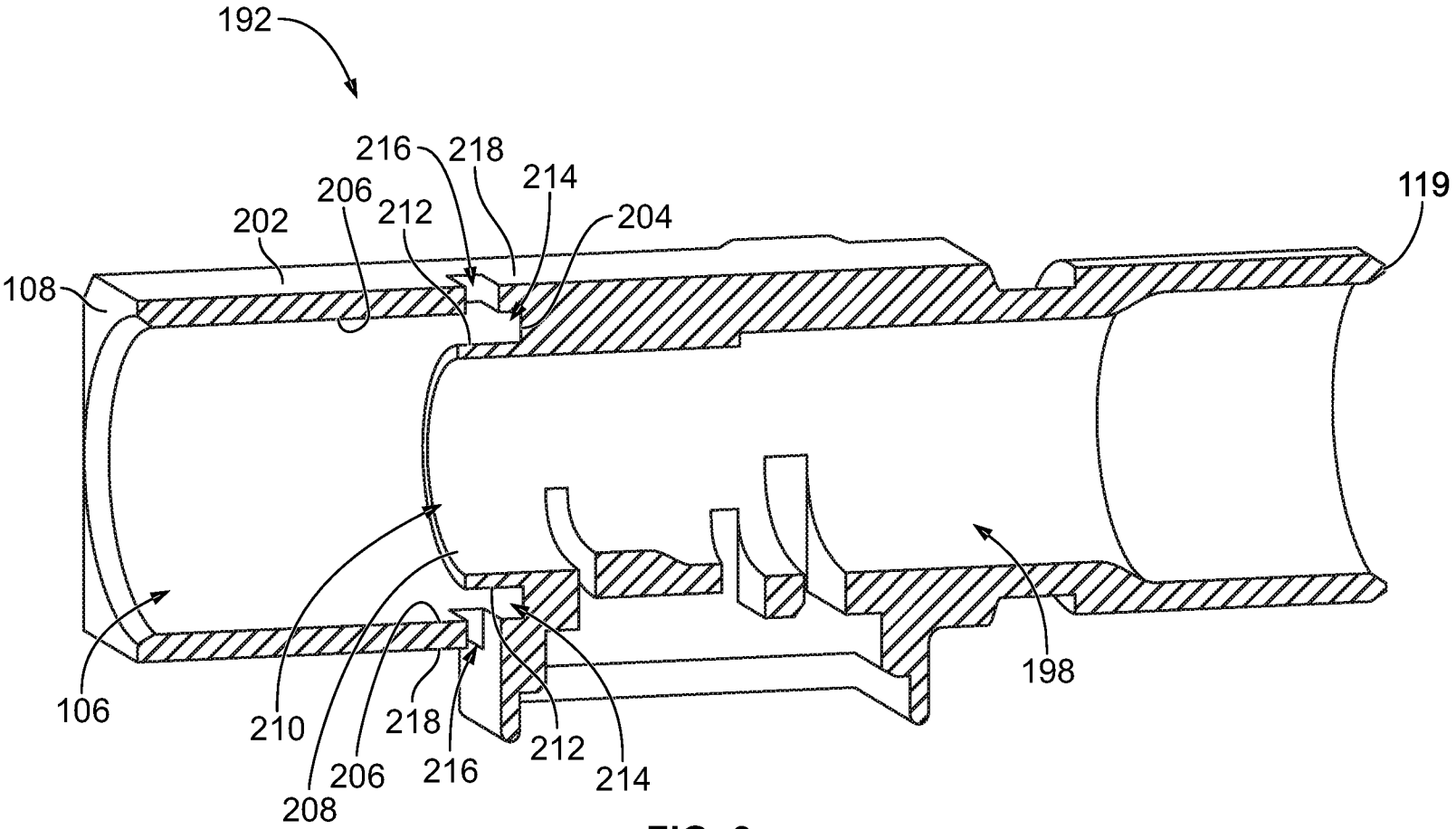
FIG. 3 is a cross-sectional perspective view of an outer housing of the second connector assembly according to an embodiment.

FIG. 3 is a cross-sectional perspective view of the outer housing 192 of the second connector assembly 104 (shown in FIG. 1) according to an embodiment. The cross-section is taken along the line A-A shown in FIG. 1. The outer housing 192 includes a mating segment 202 that extends to the mating end 108. The mating segment 202 defines the socket 106, which is a section of the cavity 198. The socket 106 is configured to receive the plug end 110 (shown in FIG. 1) of the first connector assembly 102 (FIG. 1) during a mating operation. In an embodiment, the mating segment 202 extends to the mating end 108 from a rear wall 204 of the outer housing 192. As used herein, relative or spatial terms such as "front," "rear," "left," "right," "top," or "bottom" are only used to distinguish the referenced elements and do not necessarily require particular positions or orientations in the outer housing 192 or in the connector system 100 (shown in FIG. 1) in general. An inner surface 206 of the mating segment 202 defines the socket 106 of the cavity 198. The rear wall 204 may define an axial end of the socket 106, although the cavity 198 extends beyond the rear wall 204 to the cable end 119. The outer housing 192 may be formed of a dielectric material, such as one or more plastics or other polymers. The outer housing 192 may be formed by a molding process. In an alternative embodiment, the outer housing 192 may be formed at least partially of an electrically conductive material, such as a metal.

In an embodiment, the outer housing 192 includes a boss 208 within the cavity 198. The boss 208 may have a cylindrical shape that defines an opening 210 therethrough. The boss 208 extends beyond the rear wall 204 at least partially towards the mating end 108. The boss 208 optionally is an integral component of the outer housing 192, although the boss 208 alternatively may be a separate component that is held in the outer housing 192. The boss 208 extends from the rear wall 204 for an axial length that is less than the axial length of the mating segment 202. As shown in FIG. 3, the axial length of the boss 208 is significantly less than the length of the mating segment 202, but the axial length of the boss 208 may vary in different embodiments. The opening 210 of the boss 208 defines a portion of the cavity 198. For example, the contact subassembly 196 (shown in FIG. 2) extends through the opening 210 of the boss 208 when the contact subassembly 196 is secured in position within the cavity 198 of the outer housing 192.

The boss 208 has an outer diameter defined by an outer surface 212 of the boss 208. The outer diameter of the boss 208 is less than a diameter of the socket 106 defined by the inner surface 206 of the mating segment 202 at an axial location aligned with the boss 208. In other words, the boss 208 within the cavity 198 has a smaller diameter than the inner surface 206 of the mating segment 202 that surrounds the boss 208. As a result, an annular gap 214 is defined within the cavity 198 radially between the outer surface 212 of the boss 208 and the inner surface 206 of the mating segment 202. As described in more detail below, the annular gap 214 is configured to receive an interface seal 224 (shown in FIG. 4) that is used to seal the interface between the first and second connector assemblies 102, 104 (both shown in FIG. 1). The annular gap 214 is defined in the axial direction at one end by the rear wall 204, which extends between the boss 208 and the mating segment 202. At the opposite axial end, the annular gap 214 is open to the socket 106, which allows the plug end 110 (shown in FIG. 1) of the first connector assembly 102 to engage the interface seal 224 in the annular gap 214 as the plug end 110 is received in the socket 106.

The annular gap 214 has a radial width that is defined between the outer surface 212 of the boss 208 and the inner surface 206 of the mating segment 202. In one or more embodiments, the radial width of the annular gap 214 is between 0.2 mm and 2.0 mm (including the end values of 0.2 mm and 2 mm). Optionally, the radial width may be between 0.4 mm and 1.0 mm. For example, the radial width of the annular gap 214 in an embodiment may be 0.5 mm. At such a narrow clearance, it may be difficult to load a pre-formed or pre-molded seal into the annular gap 214. For example, it may be difficult to seat a seal within the small space of the annular gap 214, especially if assembled by a person. In addition, the pre-molded seal must have a relatively thin thickness in order to fit within the radial width of the annular gap 214. If a tool or machine is used to place a pre-molded seal into the annular gap 214, the tool or machine risks tearing the thin walls of the seal, which could provide leak paths through the seal if the seal is not replaced. In an embodiment, the interface seal 224 (shown in FIG. 4) is molded in-situ within the cavity 198 of the outer housing 192, which avoids the assembly problems associated with loading a pre-molded seal with thin walls into the narrow annular gap 214.

In an embodiment, the outer housing 192 defines at least one aperture 216 that extends through the outer housing 192 from an exterior surface 218 of the outer housing 192 into the cavity 198. Two apertures 216 are shown in the illustrated embodiment, and the two apertures 216 are approximately 180° apart along the perimeter of the socket 106, but there may be different numbers of apertures and/or different relative positioning of the apertures in other embodiments. The apertures 216 in an embodiment are aligned axially with the boss 208, such that the apertures 216 open into the annular gap 214 between the boss 208 and the inner surface 206 of the mating segment 202. In addition, the apertures 216 may be at least proximate to the rear wall 204 from which the boss 208 extends. In an embodiment in which the interface seal 224 (shown in FIG. 4) is molded in-situ within the cavity 198, the one or more apertures 216 provide access to inject or otherwise apply the seal material into the annular gap 214.

Figure 4:
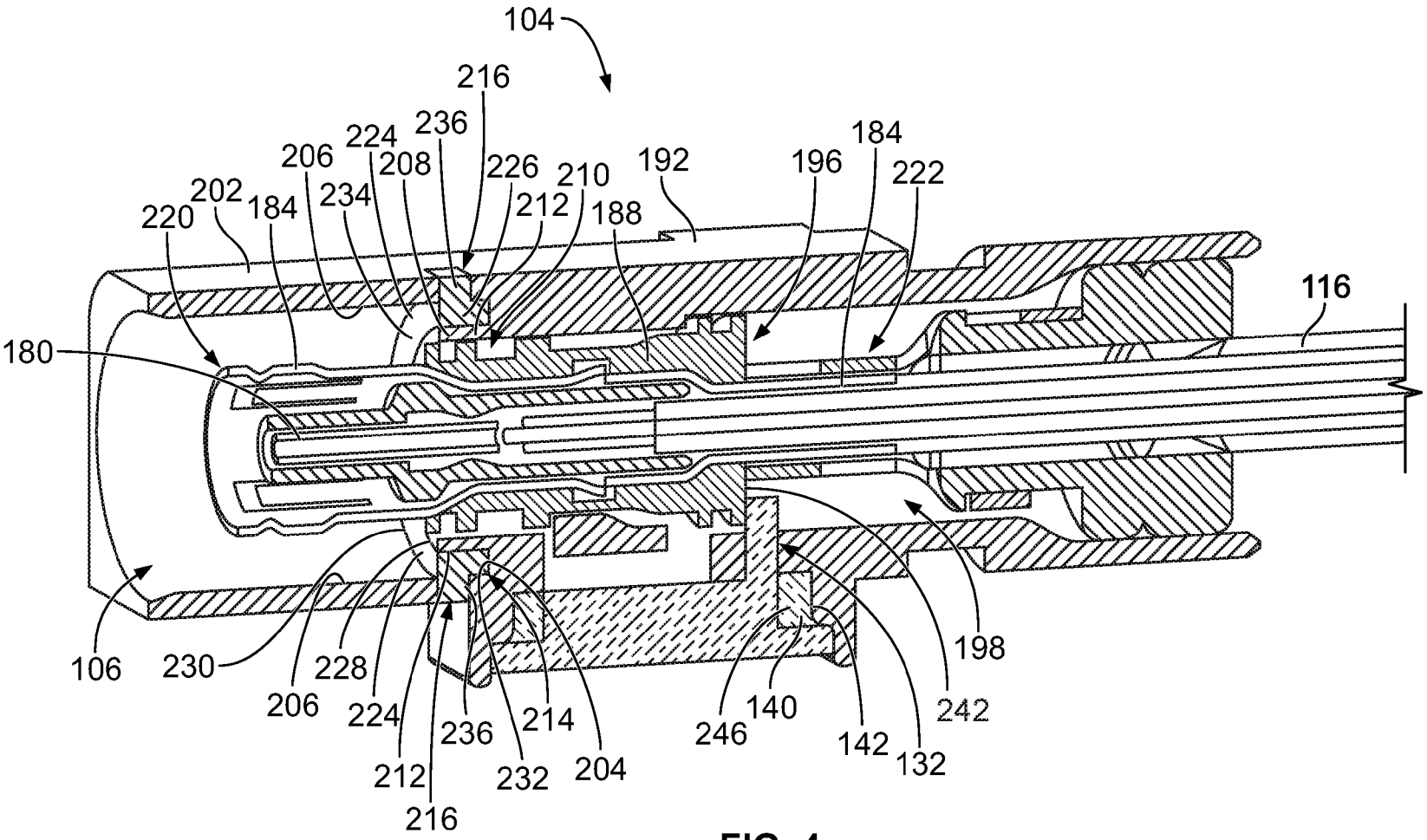
FIG. 4 is a cross-sectional perspective view of the second connector assembly according to an embodiment.

FIG. 4 is a cross-sectional perspective view of the second connector assembly 104 according to an embodiment. The illustrated embodiment shows the contact subassembly 196 loaded and held within the cavity 198 of the outer housing 192. The contact subassembly 196 extends between a contact end 220 and a terminating end 222. The terminating end 222 is terminated and electrically connected to the electrical cable 116. Optionally, both the contact end 220 and the terminating end 222 are defined by the outer contact 184. The contact subassembly 196 extends through the opening 210 of the boss 208 such that the contact end 220 is disposed within the socket 106 and is surrounded by the mating segment 202 of the outer housing 192. For example, the outer contact 184 and the center contact 180 within the socket 106 are configured to engage and electrically connect to corresponding electrical conductors of the first connector assembly 102 (shown in FIG. 1) or another mating connector assembly.

In an embodiment, the connector assembly 104 includes an interface seal 224 that is disposed at least partially within the annular gap 214. The interface seal 224 has a molded body 226 that follow contours of both the inner surface 206 of the mating segment 202 and the outer surface 212 of the boss 208 along the annular gap 214. For example, an interior side 228 of the interface seal 224 is defined by a profile of the outer surface 212 of the boss 208, and an exterior side 230 of the interface seal 224 is defined by a profile of the inner surface 206 of the mating segment 202 (except along the one or more apertures 216 that extend through the inner surface 206). As used herein, a first surface is defined by a profile of a second surface when, for example, the first surface has depressions that align with corresponding protrusions in the second surface and protrusions that align with corresponding depressions in the second surface, such that the contour of the first surface is based on and complementary to the contour of the second surface. The interface seal 224 is configured to engage the plug end 110 (shown in FIG. 1) of the first connector assembly 102 (FIG. 1) during a mating operation to seal an interface between the first and second connector assemblies 102, 104.

The molded body 226 of the interface seal 224 may substantially fill a radial width of the annular gap 214. For example, a substantial entirety of the interior side 228 of the interface seal 224 engages the outer surface 212 along the full perimeter of the boss 208. Furthermore, a substantial entirety of the exterior side 230 of the interface seal 224 engages the inner surface 206 along the full perimeter of the mating segment 202. As a result, there may be no clearance or a negligible amount of clearance between the molded body 226 and the surfaces 206, 212 that define the annular gap 214. The molded body 226 of the interface seal 224 may have a radial thickness that is substantially equivalent to the radial width of the annular gap 214. The radial thickness extends between the interior side 228 and the exterior side 230 of the interface seal 224. For example, the radial thickness in one or more embodiments may be between 0.2 mm and 2.0 mm, or more specifically between 0.4 mm and 1.0 mm. The radial thickness may be 0.5 mm in one embodiment.

In an embodiment, the molded body 226 of the interface seal 224 also engages the rear wall 204 that extends between the boss 208 and the inner surface 206 of the mating segment 202. For example, the interface seal 224 may also follow the contours of the rear wall 204 along the annular gap 214 such that a back edge 232 of the interface seal 224 is defined by a profile of the rear wall 204. Thus, the interface seal 224 may be defined by surfaces of the outer housing 192 on three sides or planes. For example, the interface seal 224 is defined radially on two sides by the outer surface 212 of the boss 208 and the inner surface 206 of the mating segment 202, and is defined axially on one side by the rear wall 204. In the illustrated embodiment, a front edge 234 of the interface seal 224 is not defined by a surface of the outer housing 192. Instead, the front edge 234 is open and exposed within the socket 106. The front edge 234 of the interface seal 224 may be configured to engage the plug end 110 (shown in FIG. 1) of the first connector assembly 102 (FIG. 1).

The interface seal 224 may be composed of a compressible polymer material. For example, the interface seal 224 may be composed at least partially of a thermoplastic elastomer material. In one embodiment, the interface seal 224 may be silicone rubber, alone or with additional materials. The interface seal 224 is compressible to conform to the plug end 110 (shown in FIG. 1) of the first connector assembly 102 (FIG. 1) during a mating operation, to fully seal the interface between the connector assemblies 102, 104.

In an embodiment, the molded body 226 of the interface seal 224 is not pre-molded or pre-formed and then loaded into the outer housing 192, but rather is formed in-situ in the outer housing 192. For example, the material of the interface seal 224 may be heated and subsequently injected or otherwise applied into the annular gap 214 of the outer housing 192. The material may be injected through the apertures 216. The heated material may be at least partially in a liquid phase, such that the material is able to flow within the annular gap 214 to fill the annular gap 214. Optionally, a removable tool may be temporarily inserted into the socket 106 during this molding process in order to provide a surface to define the front edge 234 of the interface seal 224. Alternatively, or in addition, the outer housing 192 may be tilted such that the mating segment 202 faces upwards during the molding process, so gravity forces the heated material to fill the annular gap 214 along the rear wall 204, the inner surface 206 of the mating segment 202, and the outer surface 212 of the boss 208, instead of flowing out of the annular gap 214 into the socket 106. The heated material within the annular gap 214 flows into various crevices and around various projections. The heated material may be injected through the apertures 216 until at least some of the heat material flows into and at least partially through the apertures 216.

As the heated material cools, the heated material forms the molded body 226 of the interface seal 224. Due to the flow of the heated material, the resulting molded body 226 is bonded to the surfaces it engages, such as the inner surface 206 of the mating segment 202, the outer surface 212 of the boss 208, and/or the rear wall 204. The heated material within the apertures 216 define protrusions 236 in the molded body 226 once the material has cooled. The protrusions 236 engage the edges of the outer housing 192 that define the apertures 216. The mechanical interaction between the protrusions 236 and the outer housing 192 further secures the interface seal 224 within the outer housing 192. In an embodiment, by forming the interface seal 224 in situ within the outer housing 192 instead of pre-forming the seal and attempting to load the pre-formed seal into the annular gap 214, there is no risk of tearing the seal or incorrectly positioning the seal within the cavity 198. In an alternative embodiment, however, the interface seal 224 may be pre-formed and then inserted into the outer housing 192 without forming the seal in situ.

Figure 5:
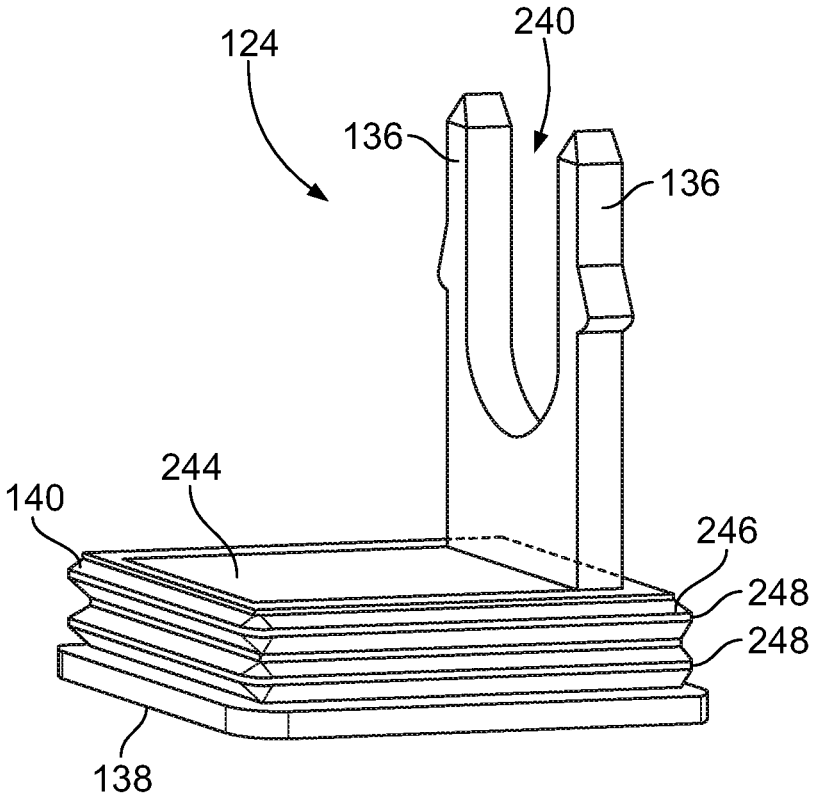
FIG. 5 is a perspective view of a retainer clip of the second connector assembly according to an embodiment.

FIG. 5 is a perspective view of the retainer clip 124 of the second connector assembly 104 (shown in FIG. 1). In the illustrated embodiment, the retainer clip 124 includes two arms 136 that extend from the base 138. The arms 136 may be formed integral to the base 138, such as during a molding process. With additional reference to FIG. 4, the arms 136 are configured to be received through the retainer opening 132 in the outer housing 192 and into the cavity 198. The retainer clip 124 defines a slot 240 between the two arms 136. As the arms 136 are received in the cavity 198 the arms 136 extend on opposite sides around the contact subassembly 196, such that the contact subassembly 196 is received in the slot 240. The arms 136 may be disposed axially to engage or be configured to engage the cavity insert 188, for example. In the illustrated embodiment, the arms 136 are disposed axially rearward of a rear end 242 of the cavity insert 188 (where "rearward" means towards the cable end 119). The rear end 242 of the cavity insert 188 has a larger diameter than the slot 240, so the arms 136 are configured to hold the axial position of the cavity insert 188 (and the other components of the contact subassembly 196 coupled to the cavity insert 188), and prevent the cavity insert 188 from moving rearward beyond the arms 136.

The retainer clip 124 has a retainer seal 140 that surrounds the base 138. The retainer seal 140 extends around and engages a flange 244 of the base 138. The arms 136 extend from the flange 244. When the retainer clip 124 is coupled to the outer housing 192, the retainer seal 140 is configured to engage the port walls 142 of the outer housing 192 that surround the retainer opening 132, as shown in FIG. 4. The retainer seal 140 seals the retainer clip 124 to the port walls 142, which indirectly seals the retainer opening 132 that is interior of the port walls 142.

In an embodiment, the retainer seal 140 has an overmold body 246 that is formed around and bonds to the flange 244. For example, the overmold body 246 may be formed in situ to the retainer clip 124, instead of being pre-formed or pre-molded and then loaded onto the retainer clip 124. The overmold body 246 may be formed by placing a mold radially around the flange 244, and filling the radial gap between the mold and the flange 244 with a heated overmold material that is at least partially liquid, so the overmold material is able to flow within the radial gap. The heated overmold material may substantially fill the radial gap such that an interior side of the overmold material follows the contours of and is defined by a profile of the flange 244. The overmold material may be a polymer, such as a thermoplastic elastomer. For example, the overmold material may be a silicone rubber. As the overmold material cools, the overmold body 246 is formed. The mold may define grooves that produce complementary ridges 248 along a perimeter of the resulting overmold body 246. Since the overmold body 246 is bonded to the flange 244, the retainer seal 140 may be strongly secured to the flange 244, which reduces the likelihood of the seal 140 rolling or otherwise moving relative to the flange 244 as the seal 140 engages the port walls 142.

Figure 6:
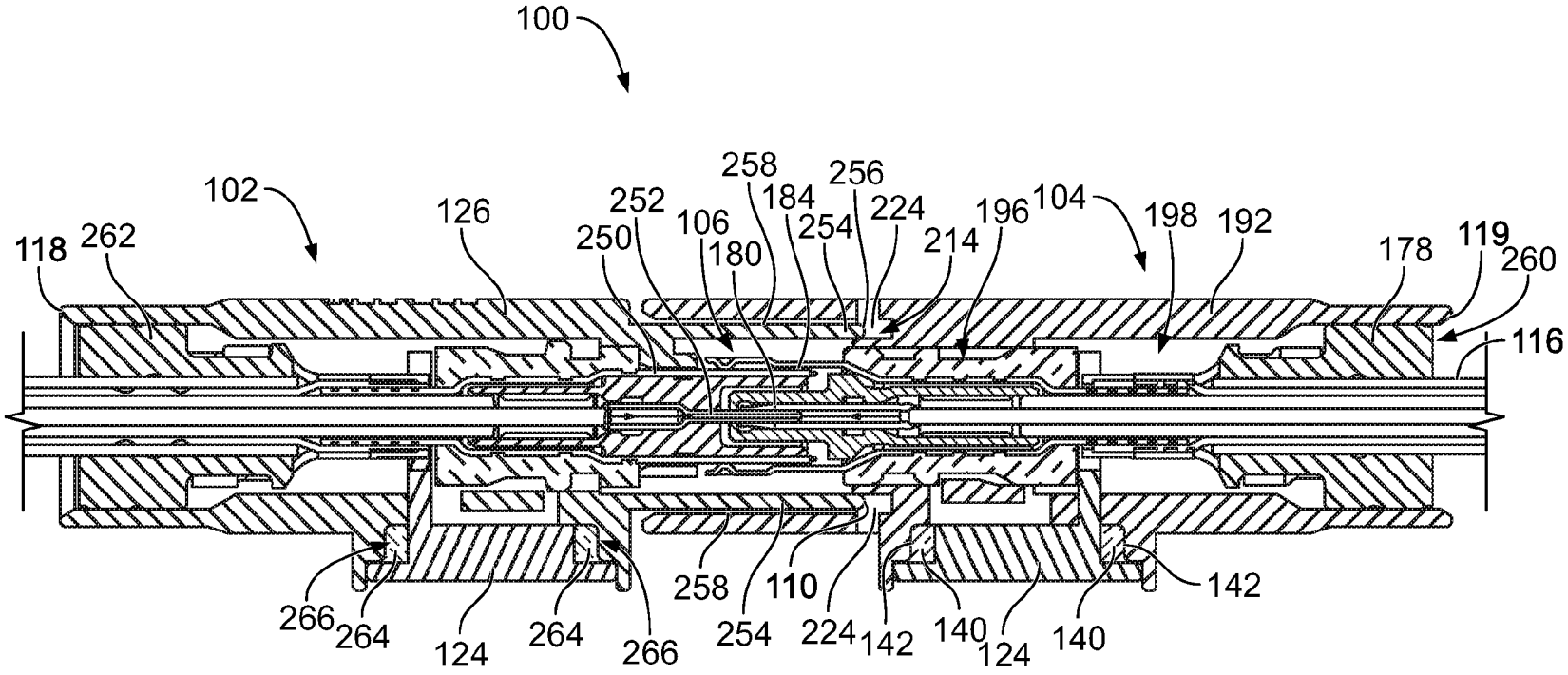
FIG. 6 is a cross-sectional side view of the connector system, including the first connector assembly and the second connector assembly, in a mated connection according to an embodiment.

FIG. 6 is a cross-sectional side view of the connector system 100, including the first connector assembly 102 and the second connector assembly 104, in a mated connection according to an embodiment. The contact subassembly 196 of the second connector assembly 104 engages and electrically connects to at least one electrical conductor of the mating first connector assembly 102. For example, the outer contact 184 of the second connector assembly 104 engages an outer contact 250 of the first connector assembly 102, and the center contact 180 engages a center contact 252 of the first connector assembly 102 to provide a conductive signal path between and across the connector assemblies 102, 104.

The plug end 110 of the first connector assembly 102 is defined by a sleeve 254 that surrounds the conductors, including the outer contact 250 and the center contact 252. The sleeve 254 is a portion of the outer housing 126. The sleeve 254 optionally may be cylindrical, or in other embodiments may be oval-shaped, elliptical-shaped, rectangular-shaped with rounded corners, or the like. In an embodiment, the socket 106 is configured to receive the sleeve 254 as the connector assemblies 102, 104 are mated, and at least part of the sleeve 254 is configured to be received within the annular gap 214 to engage the interface seal 224 within the annular gap 214. In the illustrated embodiment, a distal end 256 of the sleeve 254 (which defines the plug end 110) engages and at least partially compresses the seal 224, and the seal 224 forms around the distal end 256. The interface seal 224 functions to seal the interface between the first and second connector assemblies 102, 104. For example, any debris, contaminants, or elements present along an exterior surface 258 of the sleeve 254 is not allowed access to the contact subassembly 196 of the second connector assembly 104 or the electrical conductors of the first connector assembly 102 due to the seal that forms between the distal end 256 of the sleeve 254 and the interface seal 224. Thus, the seal provided between the interface seal 224 and the sleeve 254 plugs the separable interface between the connector assemblies 102, 104.

The second connector assembly 104 further includes the wire seal 178 disposed within the cavity 198 at the cable end 119. As described above, the wire seal 178 seals the cable end 119 between the cable 116 and the outer housing 192 by plugging a cable opening 260 of the outer housing 192. The first connector assembly 102 also may include a wire seal 262, which may have the same size and/or shape or a similar size and/or shape as the wire seal 178. Like the wire seal 178, the wire seal 262 is configured to seal the cable end 118 of the first connector assembly 102 to prevent debris, contaminants, and the elements from accessing the electrical components within the outer housing 126.

The first and second connector assemblies 102, 104 both include retainer clips 124. As described above, the retainer clip 124 of the second connector assembly 104 includes a retainer seal 140 that seals the retainer clip 124 to port walls 142. Likewise, the retainer clip 124 of the first connector assembly 102 also includes a retainer seal 264 that seals the retainer clip 124 to port walls 266 of the outer housing 126. The retainer seals 140, 264 each allow the retainer clips 124 to prohibit debris, contaminants, and elements from accessing the electrical components within the outer housings 126, 198, respectively.

Due to the interface seal 224, the wire seals 178, 262, and the retainer seals 140, 264, an axial region within the outer housings 126, 192 that spans a length between the wire seal 262 of the first connector assembly 102 and the wire seal 178 of the second connector assembly 104 is substantially sealed from external debris, contaminants, and elements when the first and second connector assemblies 102, 104 are mated to one another. In addition, the sealing protects the electrical components within the outer housings 126, 192, which may result in better signal transmission between and across the connector assemblies 102, 104 and a longer applicable lifetime of the connector system 100 before the need to replace certain components.

Figure 7:
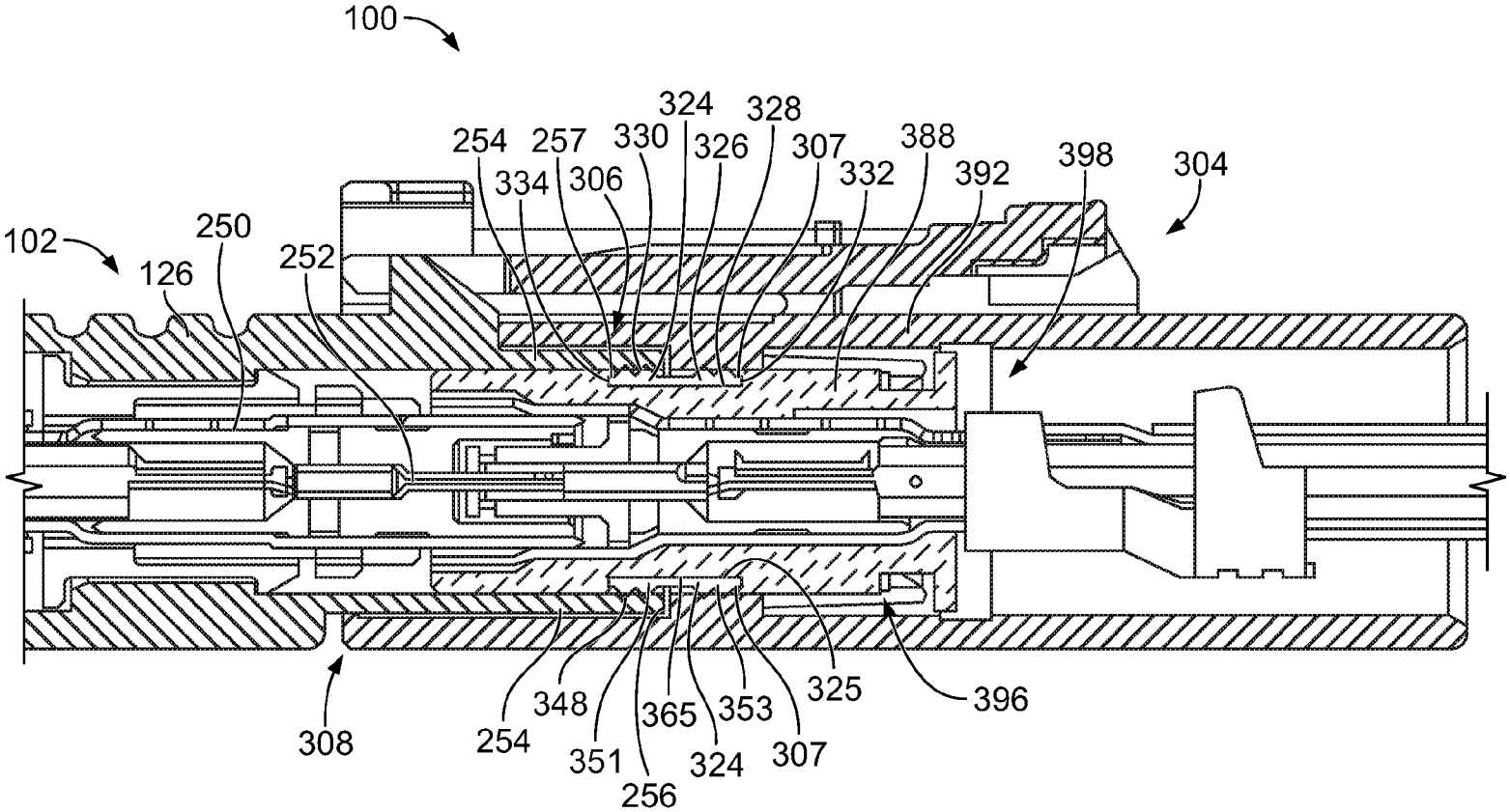
FIG. 7 is a cross-sectional side view of the connector system according to an alternative embodiment.

FIG. 7 is a cross-sectional side view of the connector system 100 according to an alternative embodiment. The connector system 100 shown in FIG. 7 includes the first connector assembly 102 and a second connector assembly 304 in a mated configuration. The second connector assembly 304 includes an electrical contact sub-assembly 396 held in an outer housing 392. The outer housing 392 defines a socket 306 at a mating end 308 that is configured to receive the sleeve 254 and one or more electrical conductors (the outer contact 250 and/or the center contact 252) of the first connector assembly 102 therein for electrically connecting to the contact sub-assembly 396. The contact sub-assembly 396 includes a cavity insert 388.

In the illustrated embodiment, an interface seal 324 is disposed on an outer surface 325 of the cavity insert 388. The interface seal 324 may have a ring-shaped molded body 326 that extends around a perimeter of the cavity insert 388. The interface seal 324 may be composed of a compressible polymer material, such as a thermoplastic elastomer material. In one embodiment, the interface seal 324 may include silicone rubber. The interface seal 324 optionally may be pre-molded or pre-formed into a ring shape, and then loaded onto the cavity insert 388 to surround and engage the outer surface 325. Alternatively, the interface seal 324 may be formed in-situ within the outer housing 392, as described with reference to the interface seal 224 shown in FIG. 4.

The interface seal 324 includes an interior side 328 that engages and seals to the outer surface 325 of the cavity insert 388 and an exterior side 330 that is configured to engage and seal to both the outer housing 392 of the connector assembly 304 and the outer housing 126 of the connector assembly 102 (for example, at a plug end of the outer housing 126). The interface seal 324 extends axially between a front edge 334 and a back edge 332. The exterior side 330 at or proximate to the back edge 332 engages and seals to the inner surface 307 of the outer housing 392. In addition, the exterior side 330 at or proximate to the front edge 334 is configured to engage and seal to the sleeve 254 or the plug end of the first connector assembly 102. Therefore, when the sleeve 254 of the connector assembly 102 is received within the socket 306 of the outer housing 392, as shown in FIG. 7, a front segment 351 of the interface seal 324 seals to the sleeve 254 and a rear segment 353 of the interface seal 324 (located rearward of the front segment 351) seals to the inner surface 307 of the outer housing 392. The front segment 351 is located between the cavity insert 388 and the sleeve 254, such that the front segment 351 engages the distal end 256 of the sleeve 254 or an inner surface 257 of the sleeve 254. The rear segment 353 is located between the cavity insert 388 and the inner surface 307 of the outer housing 392, either within the socket 306 or rearward of the socket 306 within the cavity 398. The exterior side 330 of the interface seal 324 may define ridges 348 at the front and rear segments 351, 353 to enhance compression of the interface seal 324.

During mating, as the connector assemblies 102, 304 are moved relatively toward each other, debris, water, or other contaminants may be trapped within the socket 306 along a medial segment 365 of the interface seal 324 between the front segment 351 and the rear segment 353, but the front segment 351 blocks the contaminants from entering the first connector assembly 102 through the sleeve 254, and the rear segment 353 blocks the contaminants from entering further into the second connector assembly 304.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A connector assembly comprising:

an electrical contact subassembly extending between a contact end and a terminating end, the terminating end terminated to an electrical cable, and an outer housing defining a cavity that extends between a mating end and a cable end of the outer housing, the outer housing holding the contact subassembly in the cavity, a mating segment of the outer housing extending to the mating end and defining a socket of the cavity that is configured to receive a plug end of a mating connector assembly, the outer housing further including a boss within the cavity, wherein an annular gap is defined radially between an outer surface of the boss and an inner surface of the mating segment of the outer housing, the annular gap configured to receive the plug end of the mating connector assembly, wherein the outer housing further includes an interface seal disposed in the annular gap within the cavity, the interface seal engaging both the outer surface of the boss and the inner surface of the mating segment, the interface seal configured to engage the plug end of the mating connector assembly to seal an interface between the connector assembly and the mating connector assembly.

2. The connector assembly of claim 1, wherein the boss defines an opening therethrough that defines a portion of the cavity, the contact subassembly extending through the opening such that the contact end of the contact subassembly is disposed within the socket and surrounded by the mating segment.

3. The connector assembly of claim 1, wherein the outer housing includes a rear wall extending between and connecting the boss and the mating segment of the outer housing, the rear wall defining an axial end of the annular gap, wherein the interface seal within the annular gap also engages the rear wall.

4. The connector assembly of claim 1, wherein the interface seal has a molded body that follows contours of both the inner surface of the mating segment and the outer surface of the boss along the annular gap such that an interior side of the interface seal is defined by a profile of the outer surface of the boss and an exterior side of the interface seal is defined by a profile of the inner surface of the mating segment.

5. The connector assembly of claim 1, wherein the interface seal has a molded body that is formed in-situ in the outer housing, the molded body of the interface seal filling the annular gap such that a substantial entirety of an exterior side of the interface seal engages the inner surface of the mating segment along the annular gap and a substantial entirety of an interior side of the interface seal engages the outer surface of the boss along the annular gap.

6. The connector assembly of claim 1, wherein the interface seal has a molded body that is injection molded into the annular gap between the inner surface of the mating segment and the outer surface of the boss.

7. The connector assembly of claim 1, wherein the contact subassembly includes a cavity insert surrounding at least an axial segment of an outer contact, the interface seal having an interior side that engages an outer surface of the cavity insert, the interface seal having an exterior side that engages an inner surface of the outer housing, the exterior side further configured to engage the plug end of the mating connector assembly.

8. The connector assembly of claim 1, wherein the interface seal extends axially between a front edge and a rear edge, a front segment of the interface seal at least proximate to the front edge being configured to engage the plug end of the mating connector assembly, a rear segment of the interface seal at least proximate to the rear edge engaging an inner surface of the outer housing.

9. The connector assembly of claim 1, further comprising a retainer clip that extends through a retainer opening in the outer housing into the cavity, the retainer clip configured to hold the contact subassembly in position within the cavity of the outer housing, the retainer clip including a retainer seal that engages port walls of the outer housing surrounding the retainer opening to seal the retainer opening.

10. A connector assembly comprising:

an electrical contact subassembly extending between a contact end and a terminating end, the terminating end terminated to an electrical cable;

an outer housing defining a cavity that extends between a mating end and a cable end of the outer housing, the outer housing holding the contact subassembly in the cavity, a mating segment of the outer housing extending to the mating end and defining a socket of the cavity that is configured to receive a plug end of a mating connector assembly, the outer housing further including a boss within the cavity and defining an annular gap radially between an outer surface of the boss and an inner surface of the mating segment; and an interface seal disposed within the annular gap, the interface seal having a molded body that follows contours of both the inner surface of the mating segment and the outer surface of the boss along the annular gap such that an interior side of the interface seal is defined by a profile of the outer surface of the boss and an exterior side of the interface seal is defined by a profile of the inner surface of the mating segment, the interface seal being configured to engage the plug end of the mating connector assembly during a mating operation to seal an interface between the connector assembly and the mating connector assembly.

11. The connector assembly of claim 10, wherein the molded body of the interface seal is formed in-situ in the outer housing, the molded body filling a radial width of the annular gap and being bonded to both the inner surface of the mating segment and the outer surface of the boss.

12. The connector assembly of claim 10, wherein the outer housing defines at least one aperture extending through the outer housing from an exterior surface of the outer housing into the cavity, the at least one aperture axially aligned with the boss, the molded body of the interface seal including at least one protrusion extending at least partially through the at least one aperture of the outer housing.

13. The connector assembly of claim 10, wherein the interface seal is composed at least partially of a thermoplastic elastomer material.

14. The connector assembly of claim 10, wherein the molded body of the interface seal further follows contours of a rear wall from which the boss extends, the rear wall extending between the inner surface of the mating segment and the outer surface of the boss, a back edge of the interface seal being defined by a profile of the rear wall along the annular gap.

15. A connector assembly comprising:

an electrical contact subassembly extending between a contact end and a terminating end, the terminating end terminated to an electrical cable;

an outer housing defining a cavity that extends between a mating end and a cable end of the outer housing, the outer housing holding the contact subassembly in the cavity, the electrical cable extending from the cavity through the cable end, a mating segment of the outer housing extending to the mating end and defining a socket of the cavity that is configured to receive a plug end of a mating connector assembly, the outer housing further including a boss within the cavity and defining an annular gap radially between an outer surface of the boss and an inner surface of the mating segment; and an interface seal disposed within the annular gap of the outer housing, the interface seal having a molded body that is formed in-situ in the outer housing, the interface seal configured to engage the plug end of the mating connector assembly during a mating operation to seal an interface between the connector assembly and the mating connector assembly.

16. The connector assembly of claim 15, wherein the connector assembly further includes a retainer clip that has at least one arm extending from a base of the retainer clip through a retainer opening in the outer housing into the cavity, the at least one arm engaging the contact subassembly to hold the contact subassembly in position within the cavity of the outer housing, the retainer clip including a retainer seal that surrounds the base and engages port walls of the outer housing that surround the retainer opening to seal the retainer opening.

17. The connector assembly of claim 16, wherein the retainer seal has an overmold body that is formed around and bonded to a flange of the base of the retainer clip.

18. The connector assembly of claim 15, wherein the interface seal has a molded body that follows contours of both the inner surface of the mating segment and the outer surface of the boss along the annular gap such that an interior side of the interface seal is defined by a profile of the outer surface of the boss and an exterior side of the interface seal is defined by a profile of the inner surface of the mating segment.

19. The connector assembly of claim 15, wherein the molded body of the interface seal fills the annular gap such that a substantial entirety of an exterior side of the interface seal engages the inner surface of the mating segment along the annular gap and a substantial entirety of an interior side of the interface seal engages the outer surface of the boss along the annular gap.

20. The connector assembly of claim 15, wherein the interface seal includes an interior side, an exterior side, and a front edge extending between the interior side and the exterior side, the interior side engaging the outer surface of the boss, the exterior side engaging the inner surface of the mating segment, the front edge facing the mating end of the outer housing and configured to engage the plug end of the mating connector assembly during the mating operation.

* * * * *